US009701377B2

(12) United States Patent
Kuster

(10) Patent No.: US 9,701,377 B2
(45) Date of Patent: Jul. 11, 2017

(54) SEMI SUBMARINE

(71) Applicant: Martin Kuster, Walchwil (CH)

(72) Inventor: Martin Kuster, Walchwil (CH)

( * ) Notice: Subject to any disclaimer, the term of this patent is extended or adjusted under 35 U.S.C. 154(b) by 0 days.

(21) Appl. No.: 15/164,987

(22) Filed: May 26, 2016

(65) Prior Publication Data

US 2016/0264222 A1 Sep. 15, 2016

Related U.S. Application Data

(63) Continuation of application No. 14/407,806, filed as application No. PCT/IB2013/054900 on Jun. 14, 2013, now Pat. No. 9,371,111.

(60) Provisional application No. 61/659,859, filed on Jun. 14, 2012.

(51) Int. Cl.

| | |
|---|---|
| ***B63G 8/00*** | (2006.01) |
| ***B63C 11/49*** | (2006.01) |
| ***B63B 1/12*** | (2006.01) |
| ***B63B 29/12*** | (2006.01) |
| ***B63B 1/10*** | (2006.01) |
| ***B63C 11/36*** | (2006.01) |

(52) U.S. Cl.

CPC ..... *B63C 11/49* (2013.01); *B63B 1/107* (2013.01); *B63B 1/121* (2013.01); *B63B 29/12* (2013.01); *B63C 11/36* (2013.01)

(58) Field of Classification Search

CPC ..... B63C 11/49; B63G 8/38

See application file for complete search history.

(56) References Cited

U.S. PATENT DOCUMENTS

| | | | |
|---|---|---|---|
| 3,379,157 | A | 4/1968 | Post |
| 5,117,774 | A | 6/1992 | English et al. |
| 6,302,043 | B1 | 10/2001 | Wippermann |
| 6,612,251 | B1 | 9/2003 | Ness |
| 2007/0039537 | A1 | 2/2007 | Madden et al. |
| 2015/0136005 | A1 | 5/2015 | Kuster |

FOREIGN PATENT DOCUMENTS

| | | | |
|---|---|---|---|
| DE | 10211965 | A1 | 10/2003 |
| EP | 0165192 | A1 | 12/1985 |
| FR | 2606359 | A1 | 5/1988 |
| FR | 2607101 | A1 | 5/1988 |
| WO | 93/38084 | A1 | 9/1998 |

OTHER PUBLICATIONS

International Search Report and Written Opinion in related International Application No. PCT/IB2013/054900, dated Oct. 13, 2013, 10 pages.

International Preliminary Report on Patentability in related International Application No. PCT/IB2013/054900, dated Dec. 24, 2014, 7 pages.

*Primary Examiner* — Stephen Avila

(74) *Attorney, Agent, or Firm* — Kilpatrick Townsend & Stockton LLP

(57) ABSTRACT

Described are submersible assemblies including a support structure comprising a pair of flotation devices and a cabin pivotally coupled to the support structure between the pair of flotation devices having an outer enclosure encapsulating an inner cabin, wherein the cabin is configured to rotate between a raised position above a surface of a body of water and a submerged position, wherein at least a portion of the cabin is below the surface of the body of water, and wherein the inner cabin is configured to maintain substantially the same attitude as the support structure when the cabin rotates between the raised position and the submerged position.

20 Claims, 7 Drawing Sheets

SEMI SUBMARINE

CROSS REFERENCE TO RELATED APPLICATIONS

This application is a continuation of U.S. application Ser. No. 14/407,806, now allowed, which is the U.S. national phase of International Application No. PCT/IB2013/054900 filed on Jun. 14, 2013, and published on Dec. 19, 2013 as International Publication No. WO 2013/186760 A1 ("the '760 application"), which application is related to and claims priority benefits from U.S. Provisional Application Ser. No. 61/659,859, filed on Jun. 14, 2012, SEMI SUBMARINE ("the '859 application"). The '760 and '859 applications are hereby incorporated herein in their entireties by this reference.

FIELD OF THE INVENTION

The invention relates to a semi submersible watercraft.

BACKGROUND

Various forms of watercraft for transporting passengers and/or cargo across water are known. Some of these types of watercraft are also designed to be submersible, so that the entire watercraft is displaced below a surface of a body of water.

Conventionally, the entire submersible watercraft is held above the water level through buoyancy chambers that are adjustable to control the amount overall positive buoyancy of the watercraft. Likewise, a thruster system may be used to overcome the positive buoyancy of the watercraft, allowing the entire craft to sink below the water level.

In some cases, it may be desirable to allow portions of the watercraft to remain above the water level, while allowing other portions, such as a cabin, to rotate from a raised position to a submerged position so as to provide the passengers located therewithin a below-water navigational and viewing experience.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a submersible assembly comprises a support structure comprising a pair of flotation devices and a cabin pivotally coupled to the support structure between the pair of flotation devices and comprising an outer enclosure encapsulating an inner cabin, wherein the cabin is configured to rotate between a raised position above a surface of a body of water and a submerged position, wherein at least a portion of the cabin is below the surface of the body of water, and wherein the inner cabin is configured to maintain substantially the same attitude as the support structure when the cabin rotates between the raised position and the submerged position.

According to certain embodiments, the support structure is a catamaran structure, and may comprise chambers designed to provide additional buoyancy when the cabin is in the submerged position.

According to some embodiments, the pair of flotation devices are configured to maintain an appropriate displacement with respect to the surface of the body of water. According to other embodiments, at least one of the pair of flotation devices comprise solar panels located on an upper hull, wherein the solar panels may be configured to power propulsion units of the submersible assembly.

In some embodiments, the pair of flotation devices are configured to position propulsion and steering functionality appropriately with respect to the surface of the body of water when the cabin rotates between the raised position and the submerged position. The pair of flotation devices may also comprise chambers designed to provide additional buoyancy when the cabin is in the submerged position.

In some embodiments, the submersible assembly is configured for surface navigation when the cabin is in the raised position, and is configured for subsurface or partial subsurface navigation when the cabin is in the submerged position.

The inner cabin may comprise a platform, and the platform may further comprise wheels that are coupled to a pair of tracks positioned on an inner surface of the outer enclosure. The outer enclosure may comprise a sealing portion pivotally coupled to a housing portion to provide entry and egress to the housing portion, and the housing portion may further comprise a piece having a rounded inner surface shape.

DETAILED DESCRIPTION

Figure 1:
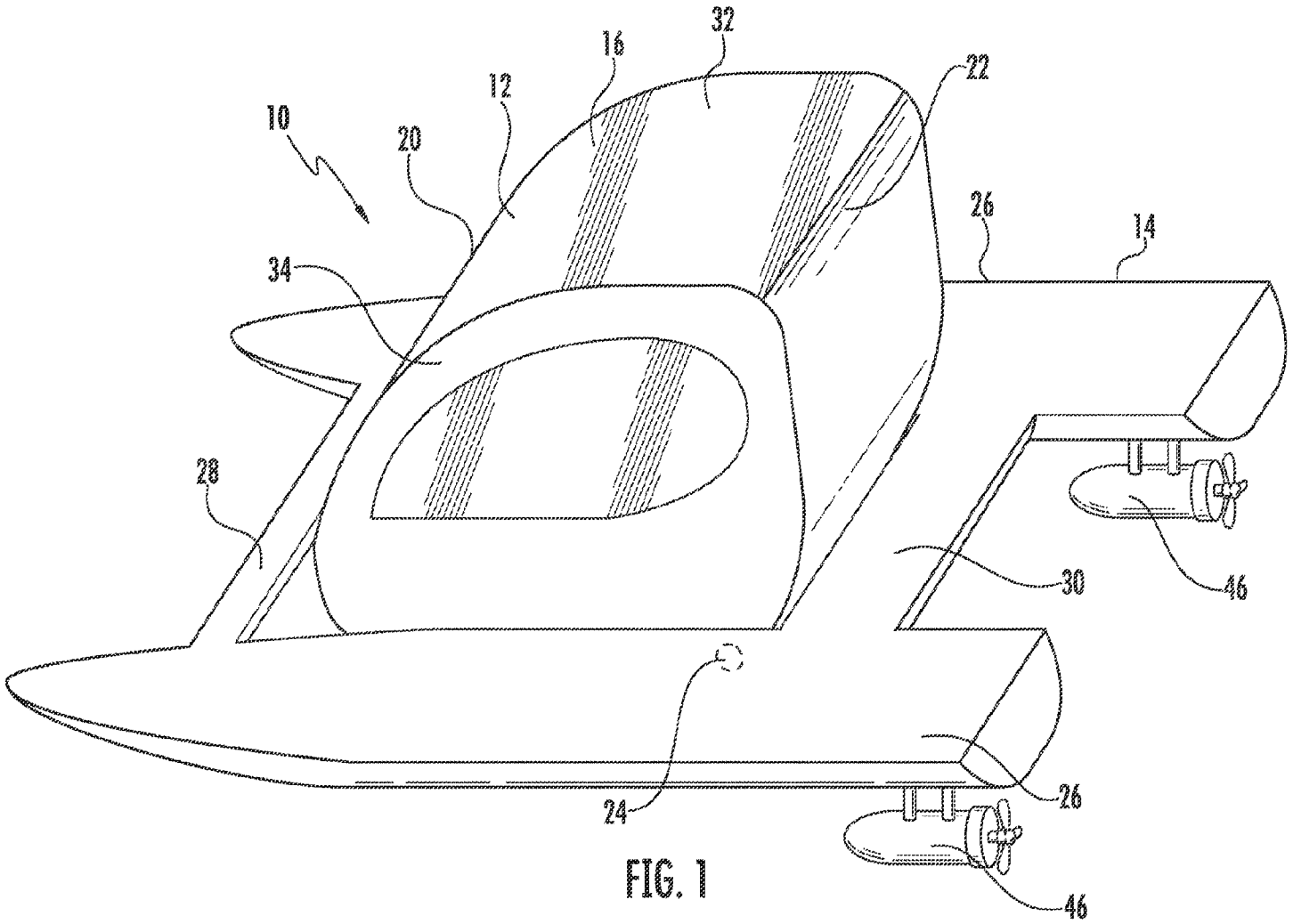
FIG. 1 is a perspective view of a submersible assembly according to certain embodiments of the present invention.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

The described embodiments of the invention provide submersible assemblies for use with a watercraft. While the submersible assemblies are discussed for use with a catamaran-type watercraft, they are by no means so limited. Rather, the submersible assemblies may be used with watercraft of any type or otherwise as desired.

FIGS. 1-7 illustrate embodiments of a submersible assembly 10. In these embodiments, the submersible assembly 10 comprises a cabin 12 and a support structure 14. In other embodiments, support structure can take the form of a monohull or other hull, such as in conventional pleasure boats.

The cabin 12 further includes an outer enclosure 16 that encapsulates an inner cabin 18. According to certain embodiments, the outer enclosure 16 includes at least a housing portion 20 and a sealing portion 22. In these embodiments, the housing portion 20 is configured to substantially surround a forward end and sides of the inner cabin 18. The sealing portion 22 is coupled to an open end of the housing portion 20 and is configured to substantially enclose the open end of the housing portion 20. In other embodiments, the housing portion 20 may surround a side and forward and aft ends of the inner cabin 18, while the sealing portion 22 surrounds an opposing side of the inner cabin 18, in the cases where the direction of rotation of the cabin 12 is from side to side relative to the orientation of the inner cabin 18. In yet other embodiments, the housing portion 20 and the sealing portion 22 may surround substantially equal portions of forward and aft regions of the inner cabin 18. One of ordinary skill in the relevant art will understand that any suitable size, shape, and orientation of the housing portion 20 and the sealing portion 22 may be used to encapsulate the inner cabin 18.

In some embodiments, it may be desirable to include a water-tight seal between the housing portion 20 and the sealing portion 22. For example, a rubber gasket or other sealing device may be used to create a substantially water-tight seal between the housing portion 20 and the sealing portion 22 when the sealing portion 22 is coupled to the housing portion 20. In these embodiments, the submersible assembly 10 may include a source of air or ventilation into the cabin 12 to ensure appropriate levels of oxygen for passengers seated within the cabin 12.

In some embodiments, the sealing portion 22 may be pivotally coupled to the housing portion 20 in a pivot location 24, wherein the sealing portion 22 may be rotated away from the housing portion 20 so as to allow entry and egress to the housing portion 20 when the cabin 12 is in a raised position. For example, as shown in FIGS. 1-7, the sealing portion 22 is pivotally coupled to a lower edge of the housing portion 20 so that when the sealing portion 22 is rotated away from the housing portion 20, the sealing portion 22 forms a walkway leading to the housing portion 20. In other embodiments, the sealing portion 22 may be pivotally coupled to an upper edge or side edge of the housing portion 20, while still being configured to rotate away from the housing portion so as to allow entry and egress to the housing portion 20. In yet other embodiments, the sealing portion 22 may also be rotated away so as to allow entry and egress to the housing portion 20 when the cabin 12 is in a submerged position, similar to an upper hatch on a conventional submarine.

Figure 7:
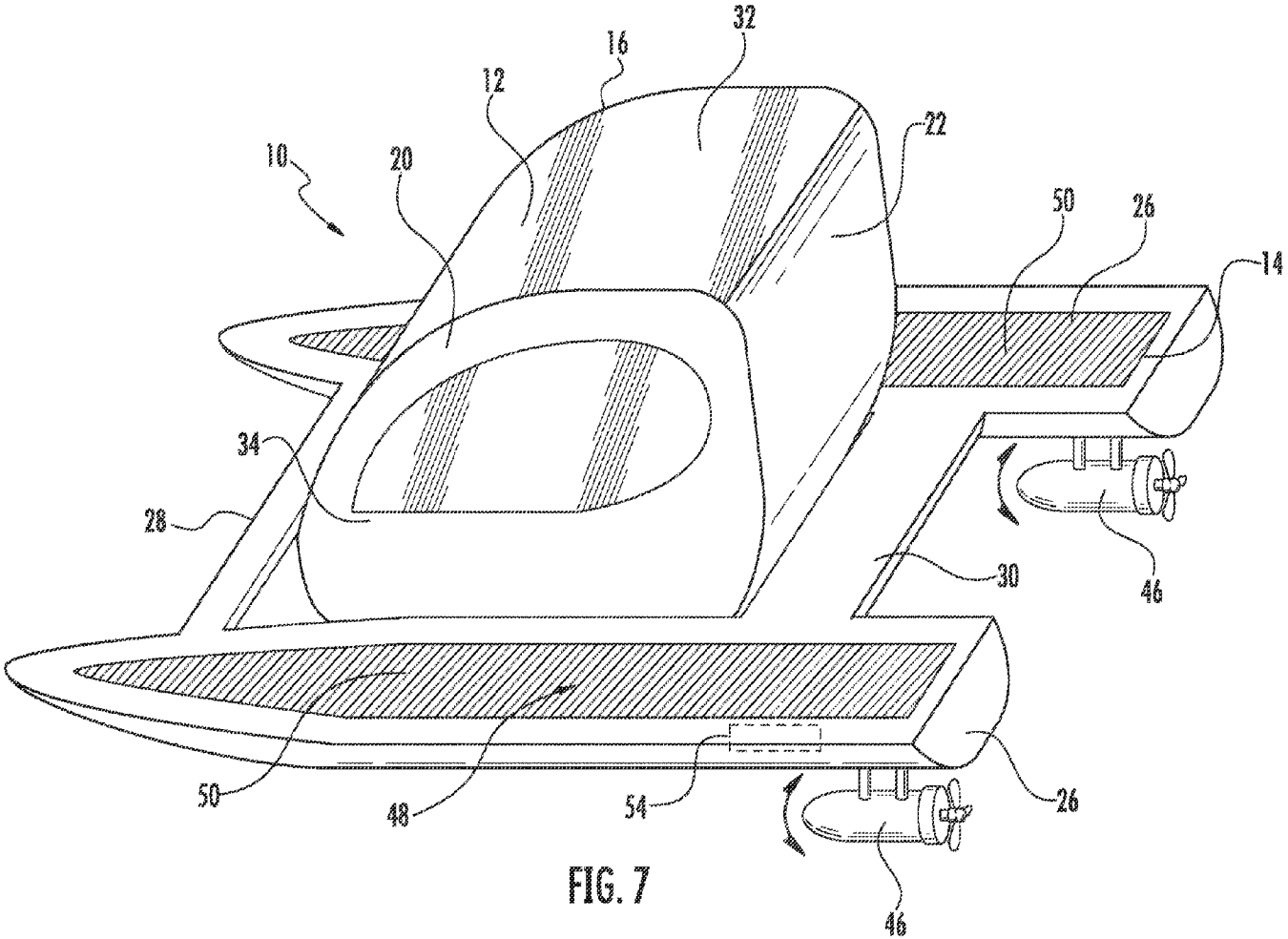
FIG. 7 is a perspective view of a submersible assembly according to certain embodiments of the present invention.

As best shown in FIGS. 1 and 7, the housing portion 20 is constructed of a piece 32 having a rounded inner surface, wherein the direction of curvature corresponds to the direction of rotation of the cabin 12. A pair of sides 34 are then coupled to the piece 32 and are shaped to enclose the piece 32. The sides 34 and the piece 32 are joined with a water-tight seal so as to prevent the introduction of water into the cabin 12 when the cabin 12 is rotated into a below-water level position. In other embodiments, one of ordinary skill in the relevant art will understand that the housing portion 20 may be formed of unitary construction between the piece 32 and the sides 34 and that the entire housing portion 20 may have a rounded, elliptical, rectilinear, or other suitable shape as needed or desired. Furthermore, at least the housing portion 20 may be constructed of a transparent or partially transparent material to allow for appropriate surface and subsurface transparency and viewing by passengers.

In some embodiments, the pivot location 24 between the housing portion 20 and the sealing portion 22 may also serve as the pivotal coupling location between the submersible assembly 10 and the support structure 14. For example, as shown in FIGS. 1 and 7, the support structure 14 includes a pair of flotation devices 26 positioned on each side of the cabin 12, wherein the flotation devices 26 may be coupled to one another via a forward connection piece 28 and an aft connection piece 30. The connection pieces 28, 30 are positioned proximate forward and aft ends, respectively, of the cabin 12 when the cabin 12 is in a raised position. As described above, in some embodiments, the submersible assembly 10 comprises a catamaran structure 14 that features the cabin 12, which can be positioned in a raised or a submerged position relative to the catamaran structure 14. In some embodiments, cabin 12 can be placed in an opening in the hull 14, preferably so that it is generally aligned with the centerline of the hull 14.

Figure 2:
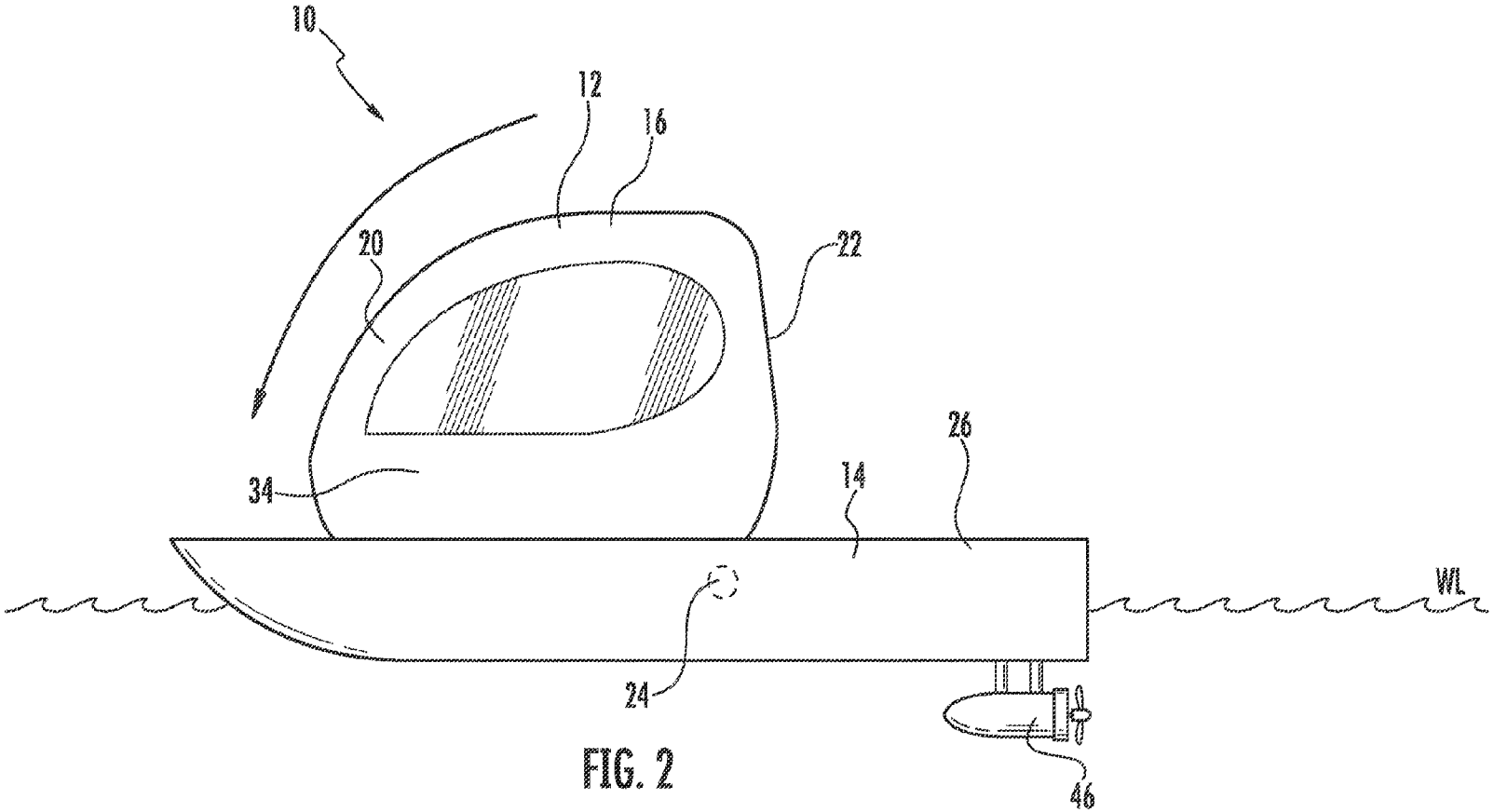
FIG. 2 is a side view of the submersible assembly of FIG. 1 with the cabin in a raised position.
Figure 3:
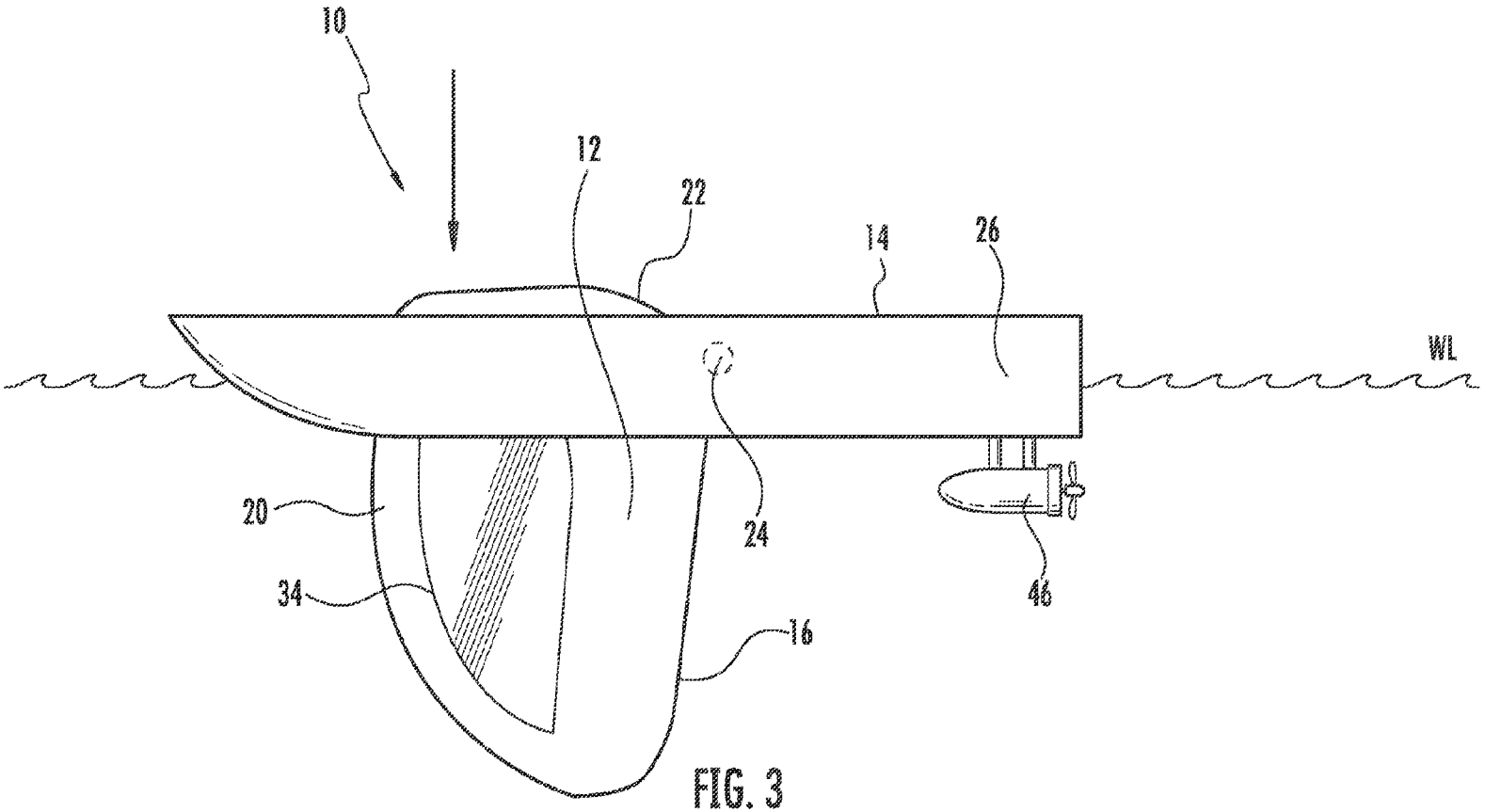
FIG. 3 is a side view of the submersible assembly of FIG. 1 with the cabin in a submerged position.
Figure 4:
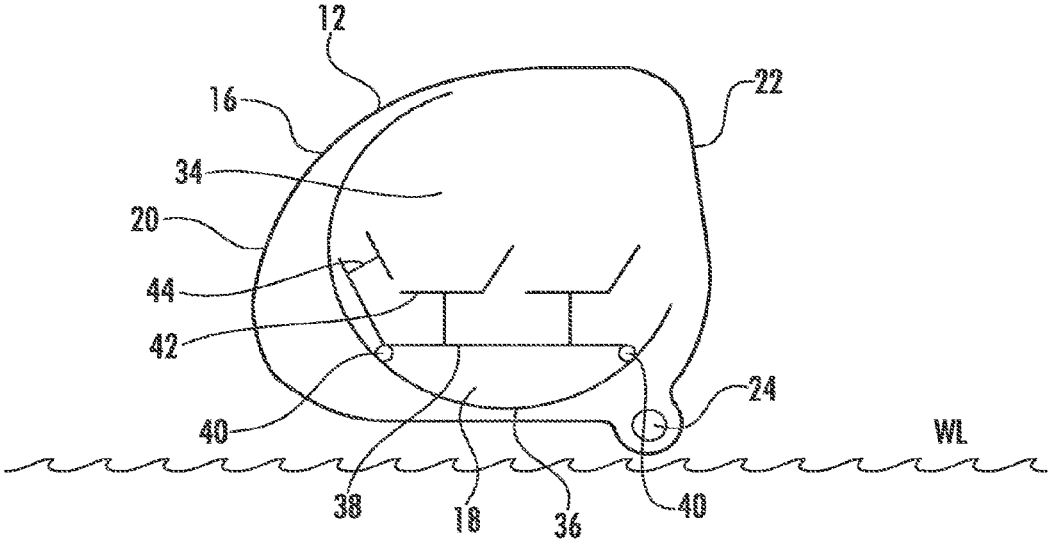
FIG. 4 is a side view of the cabin of the submersible assembly of FIG. 1 in a raised position above a water lever.
Figure 5:
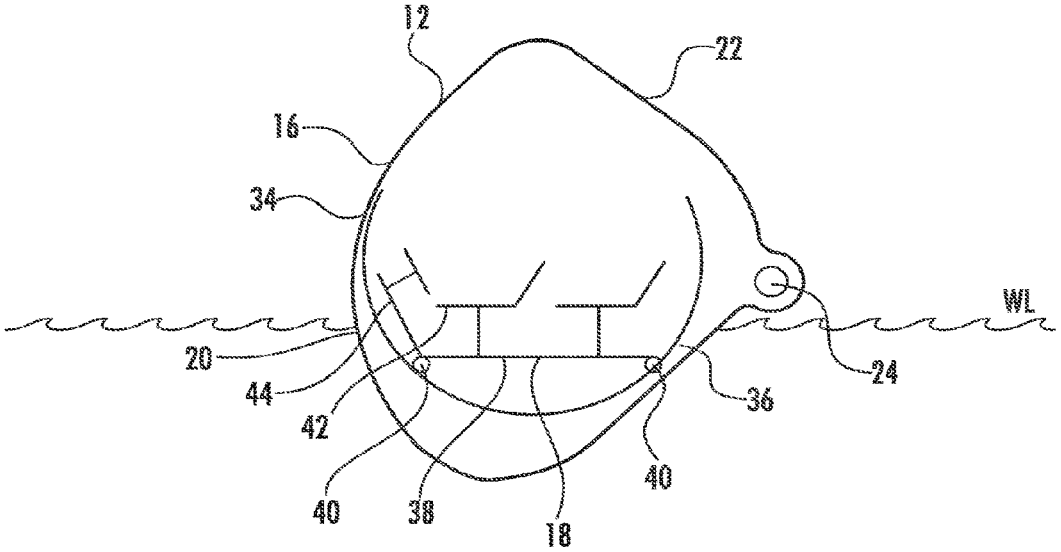
FIG. 5 is a side view of the cabin of the submersible assembly of FIG. 1 in mid-rotation between a raised position and a submerged position.
Figure 6:
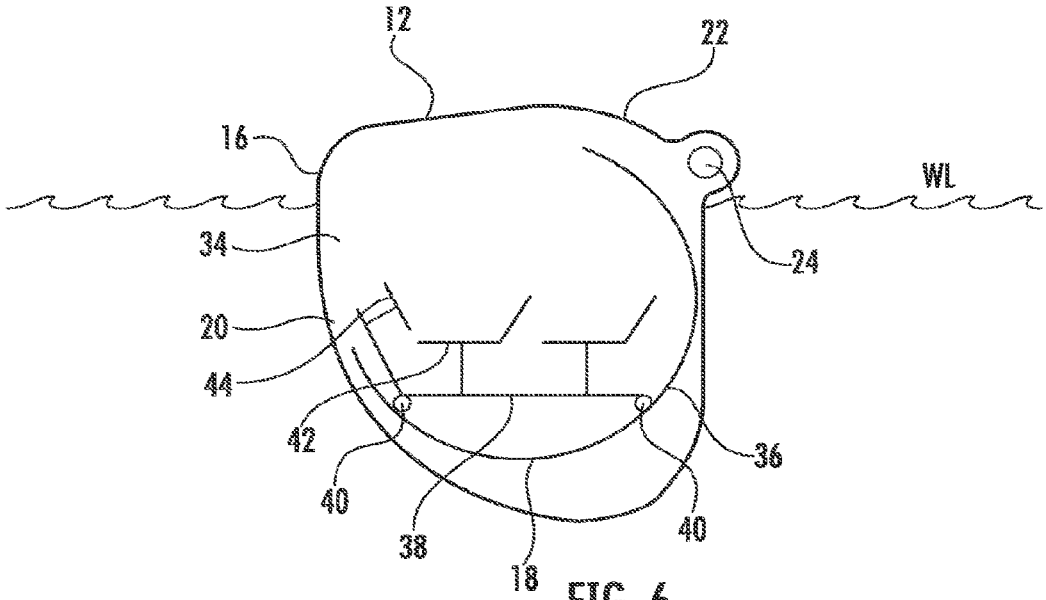
FIG. 6 is a side view of the cabin of the submersible assembly of FIG. 1 in a submerged position with at least a portion of the cabin below a water level.

As illustrated in FIGS. 2-6, the cabin 12 is configured to pivot relative to the support structure 14 from the raised position (as shown in FIGS. 2 and 4, wherein the cabin 12 is above the surface of the body of water) to the submerged position (as shown in FIGS. 3 and 6, wherein at least a portion of the cabin 12 is below the surface of the body of water). While the cabin 12 is depicted at certain heights relative to the water level, these are merely representative, as the cabin 12 may be positioned higher or lower with respect to the water level in both the raised and submerged positions. In these embodiments, the cabin 12 is suspended relative to the support structure 14 via the pivotal coupling location. In certain embodiments, one or more additional support structures may be attached to the forward connection piece 28 or the flotation devices 26 and configured to engage the cabin 12 below a lower surface of the cabin 12 to provide additional support to the cabin 12 in the raised position, while stowing out of the way when the cabin 12 is rotating to the submerged position. Likewise, these or other support structures may be configured to engage a coupling location on the housing portion 20 and/or the sealing portion 22 to provide additional support to the cabin 12 in the submerged position, while stowing out of the way when the cabin 12 is rotating to the raised position. In other embodiments, a brake or other locking device may be used to hold the cabin 12 in the desired position without the need for additional support.

The cabin 12 is configured to be positioned in the first, raised position for surface navigation, and to be positioned in the second, submerged position for subsurface or partial subsurface navigation. When the cabin 12 is positioned in any of these positions, the flotation devices 26 continue to provide appropriate displacement and to position the propulsion and steering functionality appropriately with respect to the water. Specifically, the flotation devices 26 may include chambers designed to provide additional buoyancy when the cabin 12 is lowered so as to compensate for the shift in position of the cabin 12. As a result, the submersible assembly 10 is configured to allow occupants to navigate above or below the surface of the water.

In certain embodiments, a pair of tracks 36 are coupled to the rounded surface shape of the piece 32. The inner cabin 18 may comprise a platform 38 that includes wheels 40 or other coupling devices, such as clamps, rings, or other receptacles, positioned at opposing ends of the platform 38, which are configured to couple to the pair of tracks 36. In the embodiments shown in FIGS. 4-6, the wheels 40 are positioned at forward/aft ends of the platform 38. However, one of ordinary skill in the relevant art will understand that the wheels 40 may also be positioned at left/right ends of the platform 38 or otherwise as needed or desired depending on the direction of rotation of the cabin 12 and, thus, the direction of the tracks 36. The track coupling/rounded shape design allows the inner cabin 18 to maintain substantially the same attitude or orientation with respect to support structure 14's attitude I orientation or gravity while the cabin 12 rotates between raised and submerged positions. Gimbals, bearings and I or other structure, actuated or not, with or without control and feedback functionality, may also be provided to cause such orientation to occur naturally, under control of passengers, or under automatic control, such as with use of sensors as to support structure 14's attitude I orientation or gravity. Alternatively, the entire cabin 12 may be disposed on gimbals or other structure to allow it to remain upright regardless of whether the cabin 12 is raised or submerged.

The cabin 12 can be partially or wholly transparent so that passengers have sufficient visibility when the cabin 12 is positioned in a raised or submerged position. These embodiments provide a cost efficient, easy to use, small to midsize private submersible assembly 10. It also allows for use as a normal boat and, if desired, for the cabin 12 to be lowered beneath the water surface to make submerged viewing by passengers possible.

Passenger seating 42, controls 44 for the submersible assembly 10, and other structure may be located on the platform 38 of the inner cabin 18 that maintains upright or general upright orientation relative to the horizontal plane of the support structure 14 or to gravity as required. The inner cabin 18 may further include an additional enclosure within the outer enclosure 16 as needed.

The submersible assembly 10 may include propulsion units 46 of any desired type and nature. For example, as shown in FIGS. 1 and 7, the propulsion units 46 are outboard units with propellers coupled to aft ends of the flotation devices 26, which may be rotated so that they serve to steer the craft as well as to propel it. Propulsion may be inboard or inboard/outboard, and steering may be accomplished with rudders or as otherwise desired in lieu of steerable units. The propulsion units 46 are also configured so that their operation and control is not impacted by changes in the position of the cabin 12.

The submersible assembly 10 may also include a power system 48. In these embodiments, the power system 48 may include solar panels 50 positioned on an upper hull of each flotation device 26. The energy generated by the solar panels 50 may be transferred and/or stored in batteries 54, which may be located within the flotation devices 26 and/or within the cabin 12.

These propulsion units 46 may be electric, as can other functionality aboard the craft, and may be powered by the solar panels 50 and/or by power discharged from the batteries 54. Diesel or gasoline engines can also be used for propulsion, and they may be used in combination with electric motors that receive energy from the batteries 54 driven by the solar panels 50, or electric energy from one or more diesel or gasoline engines. Pedals may also be provided so that the submersible assembly 10 may be human-powered.

The submersible assembly 10 may also comprise a warning or security system that is configured to indicate or preclude operation in water conditions that are too strong or heavy for proper operation or where risk of capsizing exceeds safe operational guidelines.

Construction may be accomplished in composites or as otherwise desired. Users of such watercraft can include private persons, rental businesses, resorts, park attractions, rescue operations (such as have need for underwater search capacity) and professionals (such as inspectors of underwater constructions). Suitable areas of operation for this embodiment can include coastal waters or freshwater waters such as lakes and rivers.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A submersible assembly comprising:

(a) a support submersible comprising a pair of flotation devices; and (b) a cabin pivotally coupled to the support structure between the pair of flotation devices and comprising an outer enclosure encapsulating an inner cabin, wherein the cabin is configured to rotate between a raised position above a surface of a body of water and a submerged position, wherein at least a portion of the cabin is below the surface of the body of water, and wherein the pair of flotation devices are configured to maintain an appropriate displacement with respect to the surface of the body of water and the inner cabin is configured to maintain substantially the same attitude as the support structure when the cabin rotates between the raised position and the submerged position, wherein the pair of flotation devices comprise chambers designed to provide additional buoyancy when the cabin is in the submerged position.

2. The submersible assembly of claim 1, wherein the pair of flotation devices are configured to position propulsion and steering functionality appropriately with respect to the surface of the body of water when the cabin rotates between the raised position and the submerged position.

3. The submersible assembly of claim 1, wherein the inner cabin comprises a platform.

4. The submersible assembly of claim 3, wherein the platform comprises wheels that are coupled to a pair of tracks positioned on an inner surface of the outer enclosure.

5. The submersible assembly of claim 1, wherein the outer enclosure comprises a sealing portion pivotally coupled to a housing portion to provide entry and egress to the housing portion.

6. The submersible assembly of claim 5, wherein the housing portion comprises a piece having a rounded inner surface shape.

7. The submersible assembly of claim 1, wherein the support structure is a catamaran structure.

8. The submersible assembly of claim 1, wherein the submersible assembly is configured for surface navigation when the cabin is in the raised position, and is configured for subsurface or partial subsurface navigation when the cabin is in the submerged position.

9. A submersible assembly comprising:

(a) a catamaran structure; and (b) a cabin pivotally coupled to the catamaran structure and comprising an outer enclosure encapsulating an inner cabin, wherein the cabin is configured to rotate between a raised position above a surface of a body of water and a submerged position, wherein at least a portion of the cabin is below the surface of the body of water, and wherein the inner cabin is configured to maintain substantially the same attitude as the catamaran structure when the cabin rotates between the raised position and the submerged position, wherein the catamaran structure comprises chambers designed to provide additional buoyancy when the cabin is in the submerged position.

10. The submersible assembly of claim 9, wherein the catamaran structure is configured to position propulsion and steering functionality appropriately with respect to the surface of the body of water when the cabin rotates between the raised position and the submerged position.

11. The submersible assembly of claim 9, wherein the inner cabin comprises a platform.

12. The submersible assembly of claim 11, wherein the platform comprises wheels that are coupled to a pair of tracks positioned on an inner surface of the outer enclosure.

13. The submersible assembly of claim 9, wherein the submersible assembly is configured for surface navigation when the cabin is in the raised position, and is configured for subsurface or partial subsurface navigation when the cabin is in the submerged position.

14. A submersible assembly comprising:

(a) a support structure comprising a pair of flotation devices, at least one of the pair of flotation devices comprising solar panels located on an upper hull; and (b) a cabin pivotally coupled to the support structure between the pair of flotation devices and comprising an outer enclosure encapsulating an inner cabin, wherein the cabin is configured to rotate between a raised position above a surface of a body of water and a submerged position, wherein at least a portion of the cabin is below the surface of the body of water, and wherein the inner cabin is configured to maintain substantially the same attitude as the support structure when the cabin rotates between the raised position and the submerged position, wherein the pair of flotation devices comprise chambers designed to provide additional buoyancy when the cabin is in the submerged position.

15. The submersible assembly of claim 14, wherein the pair of flotation devices are configured to position propulsion and steering functionality appropriately with respect to the surface of the body of water when the cabin rotates between the raised position and the submerged position.

16. The submersible assembly of claim 14, wherein the inner cabin comprises a platform with wheels that are coupled to a pair of tracks positioned on an inner surface of the outer enclosure.

17. The submersible assembly of claim 14, wherein the solar panels are configured to power propulsion units of the submersible assembly.

18. A submersible assembly comprising:

(a) a hull; and (b) a cabin pivotally coupled to the hull and comprising an outer enclosure encapsulating an inner cabin, wherein the cabin is configured to rotate between a raised position above a surface of a body of water and a submerged position, wherein at least a portion of the cabin is below the surface of the body of water, and wherein the hull is configured to maintain an appropriate displacement with respect to the surface of the body of water, the inner cabin is configured to maintain substantially the same attitude as the hull when the cabin rotates between the raised position and the submerged position, wherein the hull comprises chambers designed to provide additional buoyancy when the cabin is in the submerged position.

19. A submersible assembly according to claim 18, wherein the hull comprises a pair of flotation devices.

20. A submersible assembly according to claim 18, wherein the hull comprises a monohull.

* * * * *